US006059475A

United States Patent [19]

Jafarmadar

[11] Patent Number: 6,059,475

[45] Date of Patent: May 9, 2000

[54] APPARATUS FOR CLEANING TILE GROUT JOINTS

[76] Inventor: Hossein H. Jafarmadar, 75 Gulfstream Rd., Dania, Fla. 33004

[21] Appl. No.: 09/078,083

[22] Filed: May 13, 1998

Related U.S. Application Data

[63] Continuation-in-part of application No. 08/984,496, Dec. 3, 1997, which is a continuation-in-part of application No. 08/954,016, Oct. 20, 1997, abandoned.

[51] Int. Cl.[7] ..... A46B 11/00

[52] U.S. Cl. ..... 401/140; 401/137; 401/289; 15/50.3

[58] Field of Search ..... 401/140, 137, 401/139, 289, 196; 15/50.3, 52.2

[56] References Cited

U.S. PATENT DOCUMENTS

| | | | |
|---|---|---|---|
| 1,091,888 | 3/1914 | Lorzing | 401/140 |
| 1,122,079 | 12/1914 | Cunneen | 401/140 |
| 3,344,453 | 10/1967 | Price | 15/50.3 |
| 3,820,905 | 6/1974 | Sims | 401/140 |
| 4,875,246 | 10/1989 | MacGregor | 15/50.3 |
| 5,364,198 | 11/1994 | Skenderi | 401/140 |

*Primary Examiner*—David J. Walczak

*Attorney, Agent, or Firm*—Malin, Haley & DiMaggio, P.A.

[57] ABSTRACT

An apparatus for cleaning grout joints formed between adjacent ceramic and clay floor and wall tiles. The apparatus includes a liquid container mounted on a handle and containing liquid grout cleaner, a manual flow control valve, and a liquid dispensing head, all in fluid communication. The liquid dispensing head is connected to an end of the handle and includes a liquid outlet for dispensing liquid grout cleaning solution therefrom. A scrubbing brush is removably connected to the liquid dispensing head for allowing the user to scrub the grout joint thereby removing dirt, mold, mildew, and other unwanted debris therefrom. In a first embodiment, the container, control valve and liquid dispensing head are mounted on an elongated handle thereby providing a compact apparatus for cleaning grout joints on floors, counter tops, walls and the like. An alternate embodiment further includes a wheeled structure, having an alignment sight disposed thereon, so the user is able to guide the device along a groove by rolling the apparatus over the underlying floor tile during the cleaning process. The apparatus may further include at least one squeegee connected to the trailing end of liquid dispensing head for automatically wiping an excess cleaning solution from the surfaces of the tile as the apparatus is moved forward over a grout joint. The scrubbing brush may be rotatably connected to, and powered by, an electric motor for cleaning grout joints while requiring minimal manual effort.

1 Claim, 6 Drawing Sheets

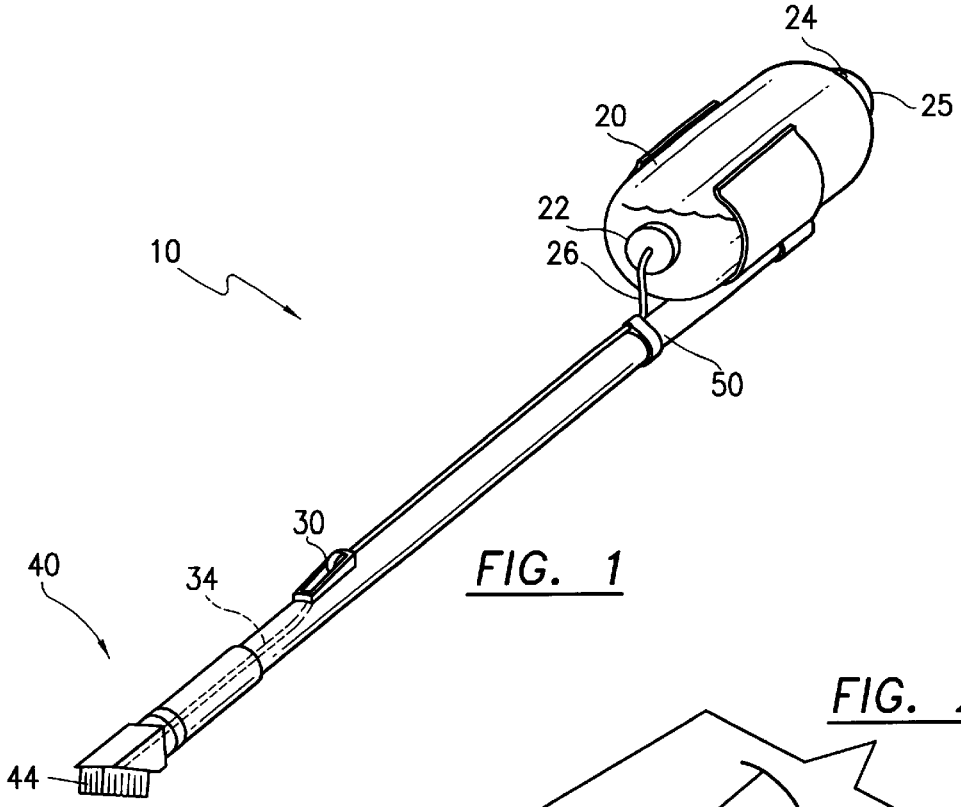
FIG. 1
FIG. 2
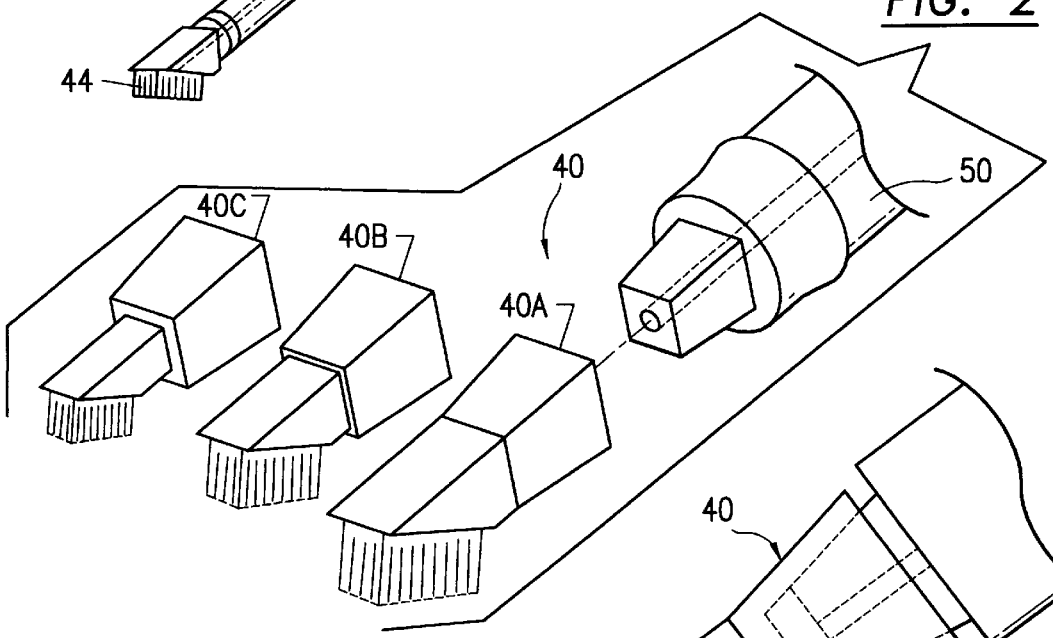
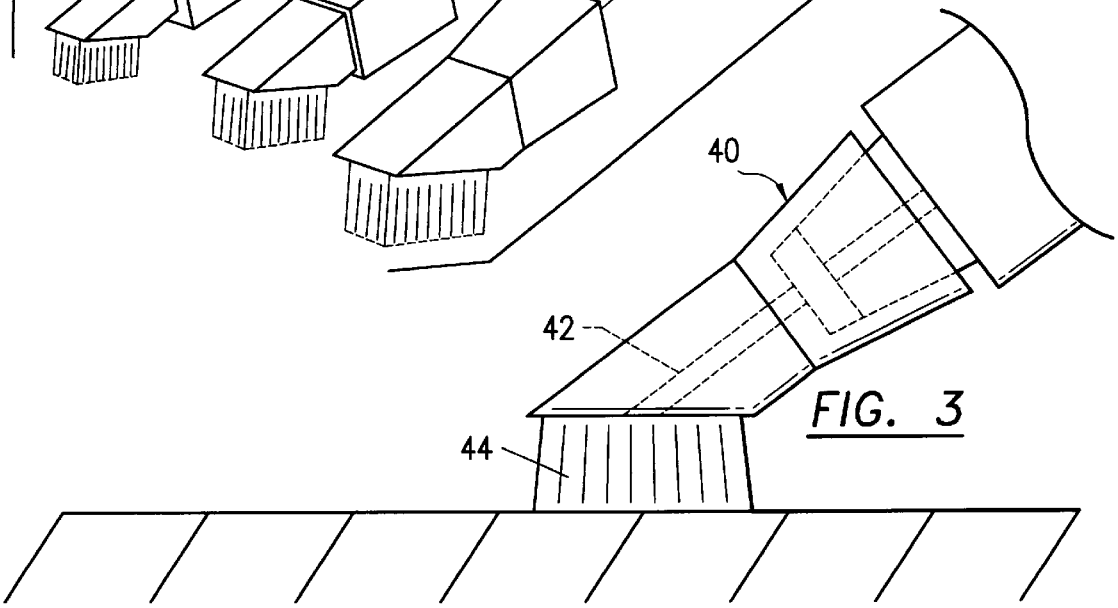
FIG. 3

400
500
421
430
420
440C
440B
440A
430
421
420
440
400

S
420

APPARATUS FOR CLEANING TILE GROUT JOINTS

This application is a continuation-in-part of application Ser. No. 08/984,496, filed Dec. 3, 1997, which is a continuation-in-part of application Ser. No. 08/954,016, filed Oct. 20, 1997, now abandoned.

BACKGROUND OF THE INVENTION

1. Field of the Invention

The present invention relates to devices for cleaning tile grout joints, such as the joints formed between ceramic and clay floor and wall tiles, and more particularly to an tile joint cleaning device having a scrubbing head capable of dispensing liquid cleaner such that tile joints may be easily cleaned.

2. Description of the Background Art

The use of ceramic and clay floor tile is well known. In recent years the use of tiles for covering floors and walls has become increasingly popular. A typical floor tile installation consists of a plurality of tiles bonded to an underlying subfloor by bonding material, including mortar and grout.

In the typical installation a layer of mortar is applied over the subfloor to be tiled. Next, floor tiles are placed on top of the mortar layer. The tiles are typically spaced relative to one another such that a gap exists between adjacent tiles. Accordingly, the space between the tiles defines the size of the gap, and gap sizes vary (depending on the type and style of tile used and the desired spacing of the tiles. Typical gap sizes range from ⅛" to ¾". Once the mortar sets, thereby fixing the tiles in place, the gaps are filled with grout. Portland cement is the base for most grout and additives are used to produce grout having specific qualities such as color, mildew resistance, hardness, etc. Furthermore, alternate grout substances, such as epoxies and silicone, are sometimes used. The grout substantially fills the gaps and results in the formation of a network of grooves between the tile.

Most tile joints, however, are easily soiled and stained and require frequent cleaning. For example, grout joints on floors are easily soiled and stained from foot traffic and spills and require frequent cleaning. In addition, tile joints in high moisture areas, such as shower stalls, often accumulate mold and mildew and require frequent cleaning. Accordingly, tile joints must be frequently cleaned to eliminate unsightly staining. One problem experienced in cleaning tile joints, however, is that tile joints are often relatively small, ranging from approximately ⅛" to ½" in width. In addition, the joints are typically recessed relative to the tile surface in the shape of a groove. The small size of the joints and recessed location, make it difficult for one to scrub the joint with a conventional cleaning sponge. Accordingly, there exists a need for tile joint cleaning device having a compact scrubbing head and a means for dispensing liquid joint cleaning solution for facilitating the cleaning of tile joints.

SUMMARY OF THE INVENTION

An apparatus for cleaning the gaps or joints, such as grout joints, existing between floor tiles and the like. A grout joint cleaning apparatus according to the present invention comprises manual tool having a compact scrubbing brush head and means associated with the head for dispensing liquid grout cleaning solution. Such a device preferably includes a rigid handle, a liquid container attached to the handle and fluidly communicating with a flow control valve for dispensing liquid cleaning solution, to a scrubbing brush head mounted on the end of the handle. In a preferred embodiment, the liquid container includes an air vent for allowing an even flow of liquid cleaning solution from the container, and the flow control valve is capable of controlling the rate of flow of liquid being dispensed by the apparatus. In one embodiment the liquid outlet nozzle is integrated within the scrubbing head such that a plurality of scrubbing brush-like bristles are disposed in surrounding relation therewith. The scrubbing head is preferably sized to correspond to the size of typical grout joints and functions to clean the joints by removing mildew, dirt, and other debris. Furthermore, the brush head is preferably removable and replaceable such that various scrubbing head sizes may be installed depending on the spacing of the tiles and corresponding grout joint width. All of the components are mounted on an elongated handle, such as a handle used for a broom, thereby providing a compact, easily used apparatus for cleaning grout joints. In an alternate embodiment, the components are reduced in size and mounted on a smaller handle thereby providing a compact hand-held apparatus for cleaning grout joints.

In an alternate embodiment intended for large-scale and/or commercial applications, the components are mounted on a wheeled structure, having a visual alignment sight disposed thereon, so the user is able to guide the device along a grout joint by rolling the wheeled apparatus over underlying floor tile during the cleaning process. The second embodiment, may further include a pair of squeegees, adjustably mounted to the trailing end of the wheeled structure, and disposed on either side of dispensing head, for wiping off excess cleaning solution from the surfaces of the tile as the device rolls forward. The present invention thus provides an apparatus for quickly and easily cleaning grout joints, by dispensing a cleaning solution directly within the confines of the grout joint and removing stains, mold, mildew and the like using scrubbing brush bristles within the narrow, and otherwise difficult to clean, confines of any sized grout joint.

Accordingly, it is an object of the present invention to provide an apparatus for cleaning grout joints existing between floor tiles and the like.

Yet another object of the present invention is to provide an improved apparatus for dispensing liquid grout cleaning solution within floor tile grout joints.

Still another object of the present invention is to provide a hand-held grout joint cleaning apparatus for dispensing liquid cleaning solution within grout grooves on walls and counter tops, in addition to floors.

A further object of the present invention is to provide an apparatus for leaning grout joints while dispensing liquid grout cleaning solution which enables the user to accurately control the flow rate of the solution.

Yet another object of the present invention is to provide an apparatus for cleaning grout joints including a pair of opposing squeegees for removing excess cleaning solution from the tile surfaces.

In accordance with these and other objects which will become apparent hereinafter, the instant invention will now be described with particular reference to the accompanying drawings.

BRIEF DESCRIPTION OF THE DRAWINGS

FIG. 1 is a front perspective view of an apparatus for cleaning grout joints according to the present invention;

FIG. 2 is a partial exploded detail view of and end portion of the apparatus shown in FIG. 1, depicting various sizes of interchangeable brush heads;

FIG. 3 is a partial detail view showing the fluid dispensing brush head;

DESCRIPTION OF THE PREFERRED EMBODIMENTS

Figure 4:
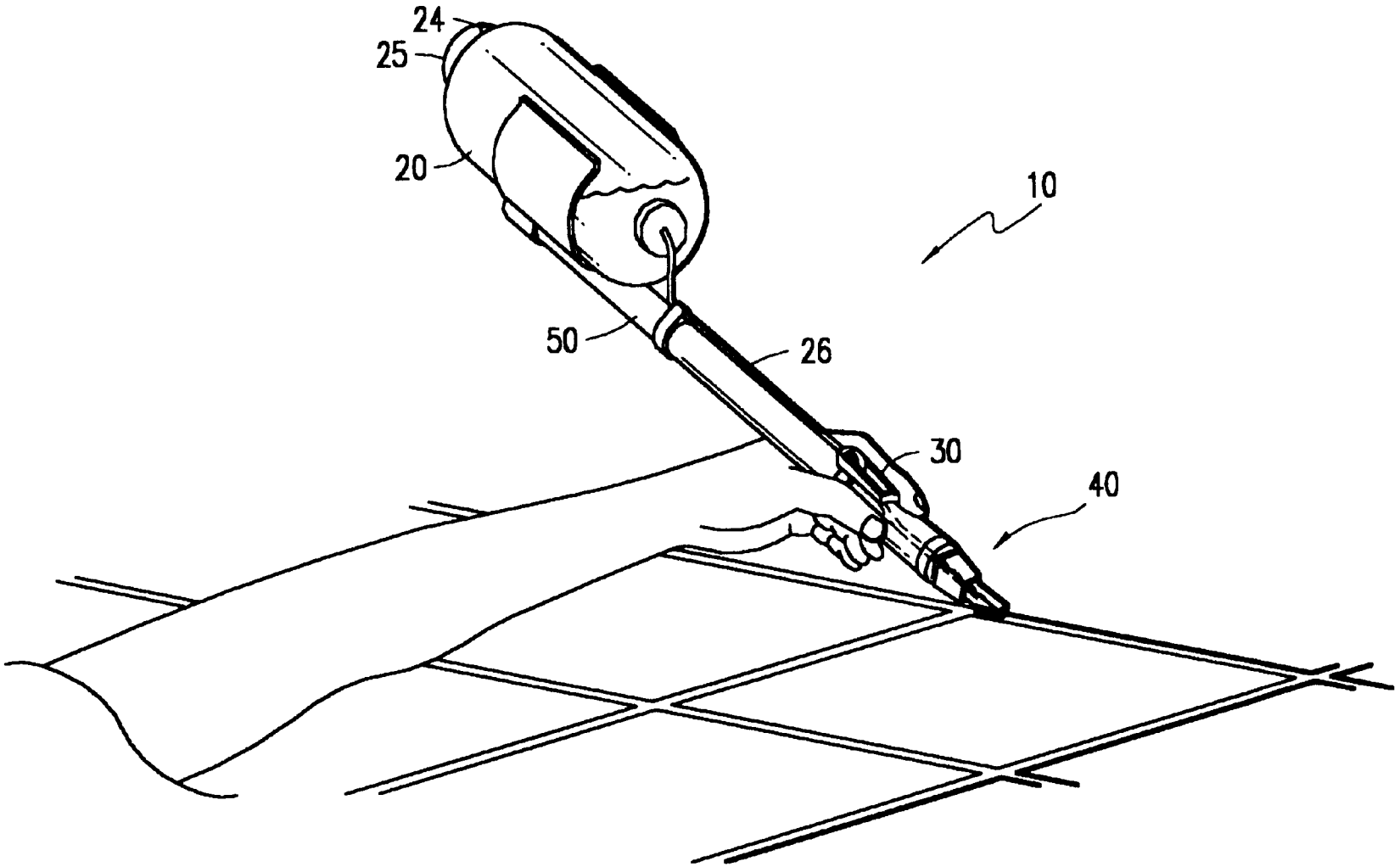
FIG. 4 is a front perspective view of a hand-held embodiment of an apparatus for cleaning grout joints showing one method of use.

FIG. 1 depicts an apparatus according to the present invention, generally referenced as 10, for use in cleaning the joints existing between installed floor tile, wall tile and the like. The apparatus includes the following primary components: liquid container 20, containing a quantity of suitable cleaning fluid; a manually actuated flow control valve 30; and, a liquid dispensing tip having a brush head 40.

In a preferred embodiment, liquid container 20 comprises a lightweight fillable container. Container 20 includes a liquid outlet 22 and an air vent 24, which cooperate to allow an even flow of liquid from the container during the dispensing process. Air vent 24 may be incorporated in a removable fill cap 25. Container 20 is fluidly connected to liquid flow control valve 30 by tubing 26. Control valve 30 comprises a manually actuated control valve and includes on, off, and intermediate flow positions for enabling the user to regulate the flow of liquid from container 20. Control valve 30 is preferably located proximate container liquid outlet 22 or in any suitable location within easy reach of the user. While fluid flow is preferably influenced by gravity (e.g. gravity flow system), in applications wherein it is necessary to apply liquid cleaning solution to elevated tile grooves, such as those found on walls, it may be desirable for container 20 to be pressurized so as to permit the solution to flow against gravity when the liquid dispensing brush head 40 is elevated with respect to container 20.

Control valve 30 is in fluid communication with a liquid dispensing brush head, generally referenced as 40, via tubing 34. Brush head 40 includes a liquid dispensing outlet 42, and a plurality of brush-like bristles 44 disposed in surrounding relation therewith. Control valve 30 preferably provides "on", "off", and intermediate flow settings, and is preferably a valve of the type known in the medical arts for controlling the flow of gravity fed intravenous solutions. In an alternate embodiment, however, control valve 30 may provide on/off settings without departing from the scope of the invention. Outlet 42 functions to dispense liquid cleaning solution from container 20, directly within the confines of a grout groove wherein the dispensed cleaning solution cooperates with bristles 44 to clean dirty grout grooves. In a preferred embodiment, at least the brush portion of the liquid dispensing head is removable and replaceable such that various brush sizes may be installed to correspond with the spacing of the tiles, and, in particular, the groove width. FIG. 2 depicts a detailed view showing interchangeable brush heads 40A–C for use with grout joints of various widths.

In a first embodiment, container 20, control valve 30, and liquid dispensing head 40 are mounted on an elongated handle 50 thereby providing a compact apparatus for dispensing liquid grout cleaning solution and scrubbing grout joints on floors, counter tops and walls. The apparatus may be hand-sized such that a user is able to manipulate the device with a single hand, or the apparatus may be slightly larger, such as broom handle sized, such that a user may manipulate the device over floors while standing.

Figure 5:
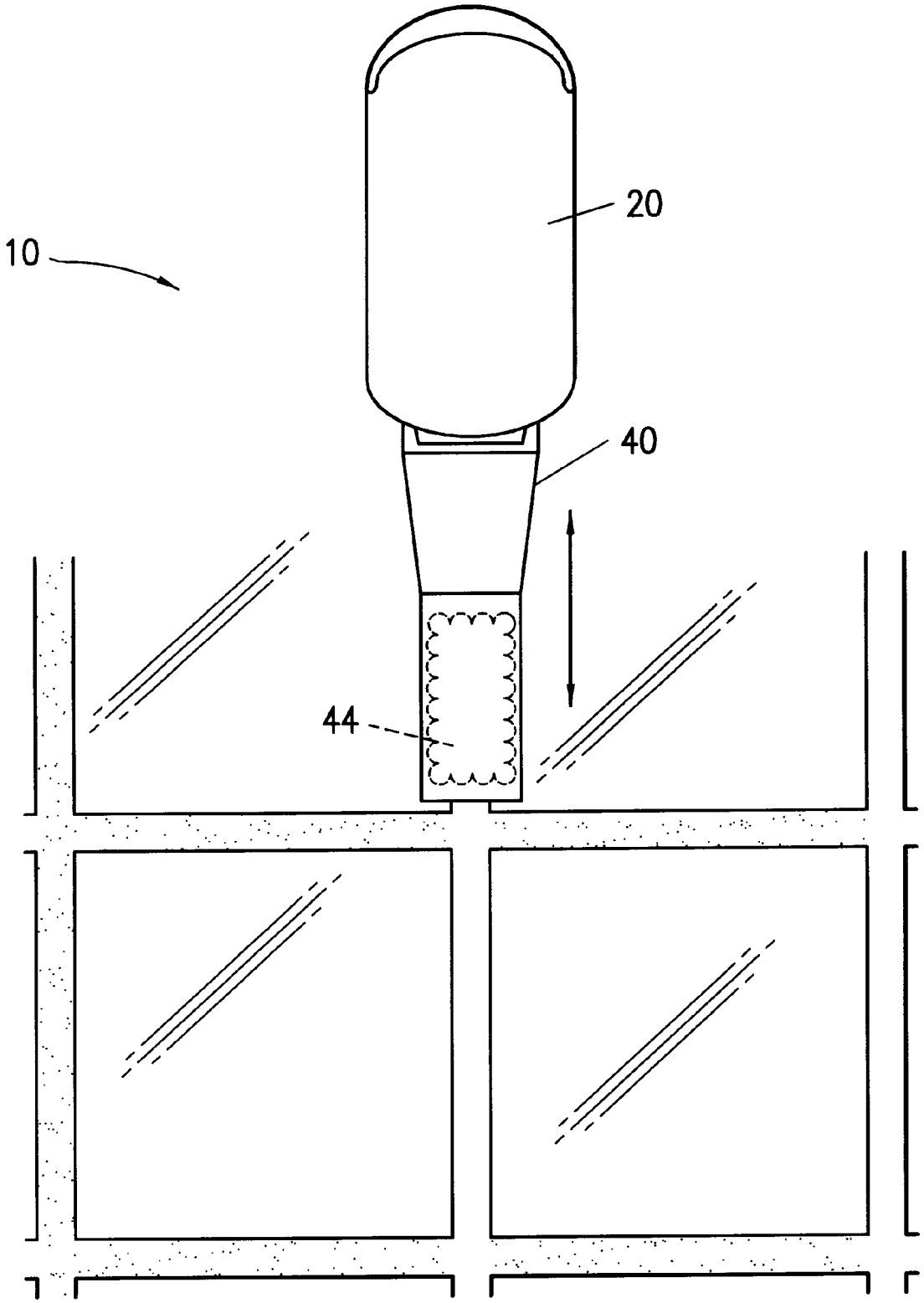
FIG. 5 is a partial top plan view of an apparatus according to the present invention in use with floor tile.

The present invention provides the user with an effective apparatus for cleaning dirty grout joints existing between a plurality of tiles. Use of the hand-held embodiment of the device is best illustrated in FIG. 4. Particularly, the user fills container 20 with a suitable liquid cleaning solution, positions the head 40, and particularly bristles 44, within a grout joint, actuates flow control valve 30 to an open, or partially open, position wherein liquid cleaning solution is allowed to flow from container 20 to liquid dispensing head 40, via tubing 26 and 34, such that the liquid exits outlet 42 and is uniformly spread over the grout within the groove by bristles 44 as the user moves the apparatus along the groove thereby allowing bristles 44 to scrub the grout joint clean. FIG. 5 illustrates a top plan view of an apparatus according to the present invention in use cleaning floor tile grout joints.

Figures 6, 7:
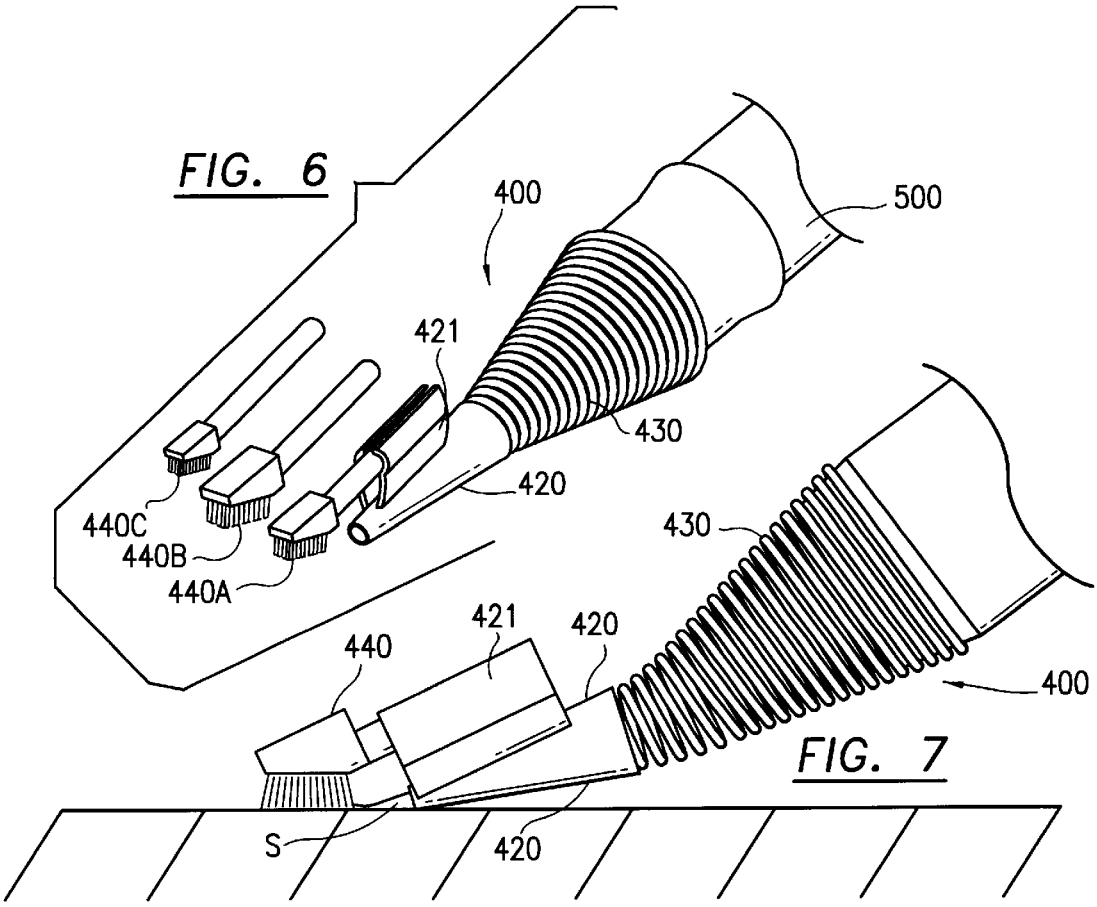
FIG. 6 is a partial top front perspective view of an alternate tip configuration.
FIG. 7 is a partial side elevational view illustrating use of the alternate tip configuration.

FIGS. 6 and 7 depict an alternate embodiment tip configuration for the device. Specifically, an alternate liquid dispensing head, referenced as 400, is disclosed. Liquid dispensing head 400 includes a liquid dispensing outlet 420 having a fastening clip 421, for removably securing a suitably sized scrubbing brush 440A, 440B or 440C. Brushes 440A–C are suitably sized for use with correspondingly sized grout grooves, and are preferably sized from ⅛" to ¾", however, it should be readily apparent that any suitable size is considered within the scope of the invention.

Liquid dispensing head 420 is connected to handle 50 by a flexible connector 430. In a preferred embodiment flexible connector 430 comprises a helical spring. As best seen in FIG. 7, flexible connector 430 provides resilient flexibility to liquid dispensing head 400, and particularly the portion thereof including liquid dispensing outlet 420, to allow the dispensing outlet to accurately ride along an undulating grout joint while dispensing grout cleaning solution "S," from container 20. Brush 440A is removably connected by clip 421 proximate liquid dispensing outlet 420, and suitably positioned while the device is in use to a trailing position with respect to outlet 420 for evenly spreading the grout cleaning solution "S" over the entire grout joint. The flexible liquid outlet 420 and trailing brush provides for a smooth, uniform, and even scrubbing pressure and the resiliency provided by flexible connector 430 increases ease of use. Preferably, at least the brush 440 portion of the liquid dispensing head 400 is removable and replaceable such that various brush sizes may be installed depending on the spacing of the tiles and the groove width. Likewise, outlet 420 may be replaceable on the liquid dispensing head 400, such that a suitably sized outlet may be matched to a specific grout joint size.

Figure 8:
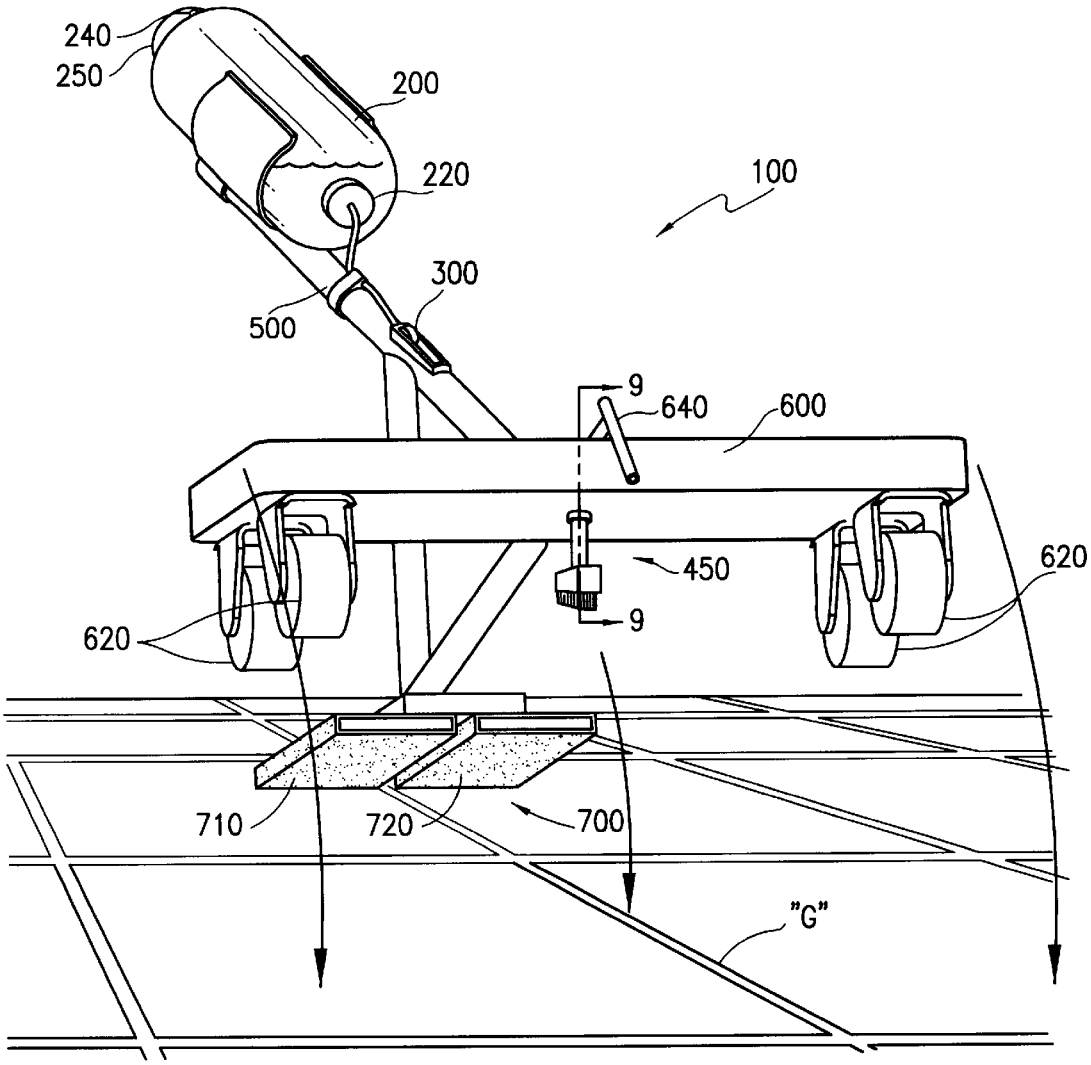
FIG. 8 is a front perspective view of an alternate embodiment apparatus according to the present invention.
Figure 9:
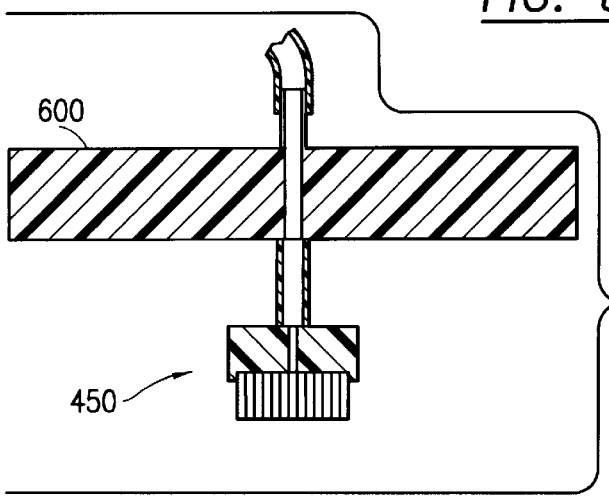
FIG. 9 is a partial sectional view along line 9—9 of FIG. 8.

FIG. 8 depicts an alternate embodiment, generally referenced as 100. The alternate embodiment apparatus includes container 200, control valve 300, liquid dispensing brush head 450, and handle 500, all of which are mounted on a wheeled assembly, including a structure 600 having a plurality of wheels 620 connected thereto, and an alignment sight 640 disposed thereon, so the user is able to guide the device along a grout joint, identified as "G", by rolling the apparatus over the underlying floor tile such that liquid cleaning solution is dispensed within the confines of the grout joint and movement of brush bristles 440 results in a scrubbing action for cleaning the joint. In the embodiment shown in FIG. 8, sight 640 provides a visual alignment device whereby a user s able to maintain brush head 450 within a tile groove by visually maintaining the sight 640 directly over, or in alignment with, the groove while moving the apparatus therealong. Wheels 620 are preferably formed from a non-scratch/non-marking material, such as plastic, and function to guide the device over the tile surfaces. Alignment site 640 is preferably centrally disposed on the leading end of the apparatus 100 and functions as a visual sight to assist the user in guiding the apparatus along the groove so that the liquid dispensing head remains within the confines of the groove. FIG. 9 shows a partial sectional view of an embodiment of the brush head 450 taken along line 9—9 of FIG. 8.

The embodiment shown in FIG. 8, may further include a squeegee assembly, generally referenced as 700, including a pair of squeegees 710 and 720, adjustably mounted to the trailing end of structure 600. In the preferred embodiment, squeegees 710 and 720 are disposed in spaced relation on either side of a centerline aligned with head 450, for automatically wiping an excess liquid from the surfaces of the tile as the device rolls forward. Furthermore, squeegees 710 and 720 are preferably adjustable and may be moved to a desirable spacing depending upon the size of the gap formed from the tile spacing (i.e. the grout joint width). Squeegees 710 and 720, are preferably adjustable to accommodate tile spacing of up to 1-inch thereby allowing the user to precisely space the squeegees for removing any excess liquid that may find its way onto the surfaces of the tiles on either side of the grout joint being cleaned. As is apparent, the present invention provides an apparatus for quickly and easily cleaning grout joints between floor tiles in a manner that results in a smooth and uniform layer of grout sealant.

Figure 10:
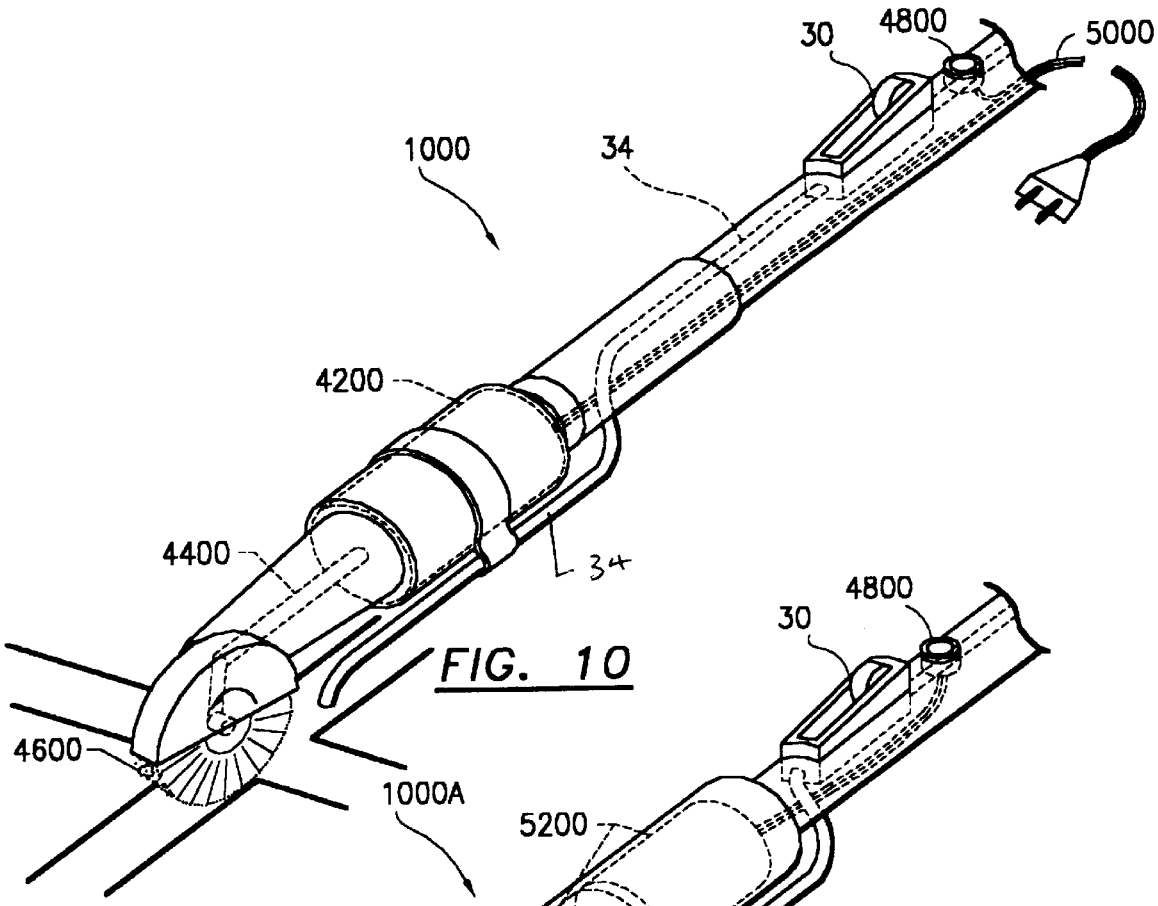
FIG. 10 is a partial perspective view of an alternate embodiment having a rotatable, electrically powered, brush.
Figure 11:
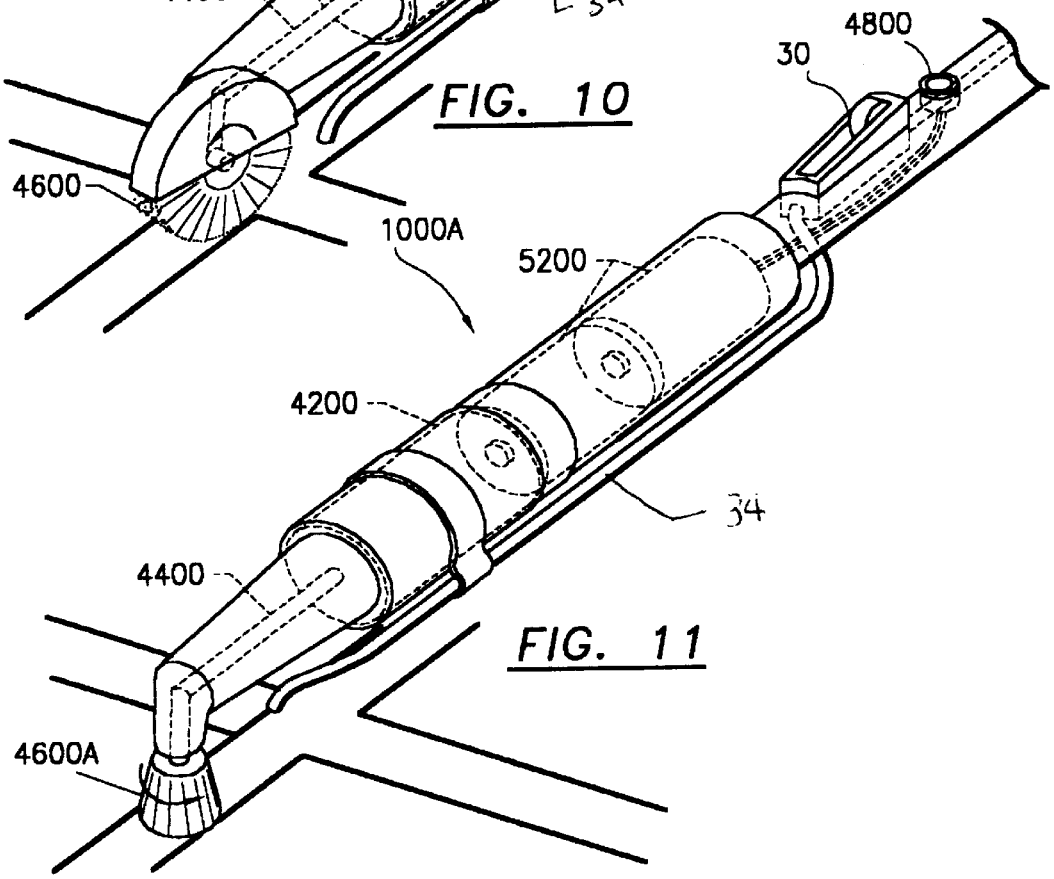
FIG. 11 is a partial perspective view of an alternate electrically powered, embodiment.

FIGS. 10 and 11 show electrically powered alternate embodiments of the present invention which are useful in cleaning grout joints while requiring less manual effort on behalf of the user. The embodiment depicted in FIG. 10, generally referenced as 1000, depicts an electrically powered embodiment. An electrically powered embodiment preferably includes an electric motor 4200, having a rotatable output shaft 4400 connected to a brush 4600 rotatably connected at an end of a handle. Power may be supplied to electric motor 4200 from either a battery (D.C. motor), or by connection of a power cord to a suitable electrical outlet (A.C. motor). FIG. 10 depicts an A.C. powered embodiment and includes a power cord 5000 electrically connected to motor 4200 for receiving power from an electric receptacle. A manually actuated electrical switch 4800 allows the user to selectively energize the motor/rotatable brush. In the embodiment depicted in FIG. 10, the brush is rotatable about an axis parallel to the underlying work surface (e.g. grout joint). An alternate electrically powered embodiment is depicted in FIG. 11, and is generally referenced as 1000A. The alternate electrically powered embodiment preferably includes an electric motor 4200, having a rotatable output shaft 4400 connected to an alternate rotatable brush 4600A configuration. In the embodiment depicted in FIG. 11, the brush is rotatable about an axis normal to the underlying grout joint and tile surfaces. Furthermore, the embodiment shown in FIG. 11, includes batteries 5200 and manually actuated electrical switch 4800 for allowing the user to selectively energize motor 4200. Each of the embodiments depicted in FIGS. 10 and 11, include conduit 34 and manual control valve 30 communicating with a container of liquid cleaning solution (not shown) as more fully disclosed hereinabove. Conduit 34 preferably terminates proximal to rotatable brush 4600 or 4600A as shown for dispensing liquid cleaning solution directly to the portion of the grout joint to be cleaned. Accordingly, liquid cleaning solution may be dispensed within a grout joint and directly adjacent to a rotating scrubbing brush to facilitate cleaning of the joint with minimal manual effort on behalf of the operator/user.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method of cleaning grooves containing grout existing between installed tiles, from a standing position comprising:

providing an apparatus with an elongated handle of sufficient length for operation in a stand-up position by a user, a liquid container connected to an end of said handle, a manual flow control valve fluidly communicating with said container, a liquid dispensing outlet connected to said handle and in fluid communication with said valve, and a scrubbing brush having bristles wherein said brush is removably connected to said liquid dispensing outlet;

filling said liquid container with a suitable liquid cleaning solution;

grasping said handle;

positioning said brush over said groove to be cleaned;

actuating said valve to an open position thereby allowing said cleaning solution to flow from said container to said dispensing outlet such that said cleaning solution exits said dispensing outlet and is uniformly spread within said groove; and moving said apparatus along said grout filled groove thereby allowing said bristles to scrub said groove until clean.

* * * * *